United States Patent [19]

Cawlfield et al.

[11] Patent Number: 4,770,756

[45] Date of Patent: Sep. 13, 1988

[54] ELECTROLYTIC CELL APPARATUS

[75] Inventors: David W. Cawlfield; Jimmy M. French, both of Cleveland, Tenn.

[73] Assignee: Olin Corporation, Cheshire, Conn.

[21] Appl. No.: 77,915

[22] Filed: Jul. 27, 1987

[51] Int. Cl.[4] ..... C25B 9/00; C25B 13/02; C25B 13/04; C25B 15/08

[52] U.S. Cl. ..... 204/263; 204/279; 204/283; 204/284

[58] Field of Search ..... 204/252–258, 204/263–266, 279, 283, 290 R

[56] References Cited

U.S. PATENT DOCUMENTS

| | | | |
|---|---|---|---|
| 2,193,323 | 3/1940 | Nitzschke et al. | 204/9 |
| 3,472,747 | 10/1969 | Smith | 204/72 |
| 3,523,069 | 8/1970 | Oloman | 204/92 |
| 3,748,238 | 7/1973 | Heit et al. | 204/92 |
| 3,920,551 | 11/1975 | Cook, Jr. et al. | 204/92 |
| 4,110,191 | 8/1978 | Specht et al. | 204/263 X |
| 4,144,146 | 3/1979 | Leutner et al. | 204/92 |
| 4,214,969 | 7/1980 | Lawrance | 204/255 |
| 4,311,997 | 3/1982 | Wortley | 204/280 |
| 4,409,085 | 10/1983 | Kadija et al. | 204/263 X |
| 4,526,663 | 7/1985 | Yoshida et al. | 204/283 X |
| 4,581,114 | 4/1986 | Morris et al. | 204/267 |
| 4,604,171 | 8/1986 | Morris et al. | 204/283 X |
| 4,615,775 | 10/1986 | de Nora et al. | 204/263 X |
| 4,639,303 | 1/1987 | Staab et al. | 204/258 |
| 4,692,229 | 9/1987 | Bjäreklint et al. | 204/283 X |

FOREIGN PATENT DOCUMENTS

| | | | |
|---|---|---|---|
| 0185269 | 6/1986 | European Pat. Off. . | |
| 2334647 | 1/1975 | Fed. Rep. of Germany | 204/256 |
| 56-87682 | 7/1981 | Japan . | |
| 1045675 | 10/1966 | United Kingdom . | |

*Primary Examiner*—Donald R. Valentine
*Attorney, Agent, or Firm*—Ralph D'Alessandro

[57] ABSTRACT

A separator for use in an electrolytic cell between the anode and a cation exchange membrane is provided to prevent the membrane from touching the anode, the separator having a central mesh portion that is hydrophilic and a surrounding peripheral frame portion.

15 Claims, 5 Drawing Sheets

ELECTROLYTIC CELL APPARATUS

BACKGROUND OF THE INVENTION

This invention relates to a separator for use between an electrode and a membrane in an electrochemical membrane cell. More particularly the present invention relates to the separator structure and construction used for the commercial production of concentrated hydrosulfite solutions in an electrochemical membrane cell.

Many unsuccessful attempts have been made at developing a process for manufacturing alkali metal hydrosulfites, such as sodium hydrosulfite or potassium hydrosulfite, electrochemically that can compete commercially with conventional zinc reduction processes using either sodium amalgam or metallic iron. The electrochemical process for making hydrosulfite involves the reduction of bisulfite ions to hydrosulfite ions. For this process to be economical, current densities must be employed in a cell which are capable of producing concentrated hydrosulfite solutions at high current efficiencies.

Further, where the solutions, which are strong reducing agents effective as bleaching agents, are to be used in the paper industry, the undesirable byproduct formation of thiosulfate as an impurity from hydrosulfite must be minimized. At high concentrations of hydrosulfite, however, this byproduct reaction becomes more difficult to control.

Additionally, prior electrochemical routes to hydrosulfite have produced aqueous solutions which are unstable and decompose at a rapid rate. This high decomposition rate of hydrosulfite appears to increase as the pH decreases or the reaction temperature increases. One approach to control the decomposition rate is to decrease the residence time of the solution in the cell and to maintain the current density as high as possible up to a critical current density above which secondary reactions will occur due to polarization of the cathode.

Some of the processes of the prior art, which claim to make hydrosulfite salts electrochemically, require the use of water-miscible organic solvents, such as methanol, to reduce the solubility of the hydrosulfite and prevent its decomposition inside the cell. The costly recovery of the methanol and hydrosulfite makes this route uneconomical.

The use of zinc as a stabilizing agent for hydrosulfites in electrochemical processes has also been reported, but because of environmental considerations, this is no longer commercially practical or desirable.

More recently, U.S. Pat. No. 4,144,146 issued Mar. 13, 1979 to B. Leutner et al describes an electrochemical process for producing hydrosulfite solutions in an electrolytic membrane cell. The process employs high circulation rates for the catholyte which is passed through an inlet in the bottom of the cell and removed at the top of the cell to provide for the advantageous removal of gases produced during the reaction. Catholyte flow over the surface of the cathodes is maintained at a rate of at least 1 cm per second and the cathode is formed of fibrous mats of compressed sintered fibers with a mesh spacing of 5 mm or less. The process is described as producing concentrated solutions of alkali metal hydrosulfites at commercially viable current densities; however, the cell voltages required are high, being in the range of 5 to 10 volts. This results in excessive energy consumption. There is no indication of the concentrations of thiosulfate impurity in the product solutions.

The availability of electrodes with a high mass transfer surface area having a high surface area to volume ratio and sufficient porosity have limited the development of a commercially practical electrochemical cell design for the production of aqueous solutions of alkali metal sulfites with low concentrations of alkali metal thiosulfates as impurities. The electrodes must also seal well, be uniformly spaced apart, easily assembled and not contribute to the production of thiosulfate impurities.

These and other problems are solved in the design of the present invention employing an improved separator between the anode and the membrane in an electrolytic membrane cell for the production of alkali metal hydrosulfite.

SUMMARY OF THE INVENTION

It is an object of the present invention to provide an improved separator for use in an electrochemical cell.

It is another object of the present invention to provide an improved separator which prevents the membrane from contacting the anode in an improved electrochemical cell for the production of aqueous alkali metal hydrosulfite solutions.

It is a further object of the present invention to provide an improved separator that permits the electrical current to flow to the cathode only in those areas where catholyte fluid is actively circulated in an electrochemical membrane cell producing aqueous alkali metal hydrosulfite solutions with low alkali metal thiosulfate impurity concentrations at high current densities.

It is a feature of the present invention that the improved separator is positioned between the anode and the membrane and provides uniform spacing between adjacent anodes and cathodes in the assembled electrochemical membrane cell.

It is another feature of the present invention that the improved separator is easily sealed with the adjacent membrane by having a central mesh portion and a peripheral solid frame portion against which a sealing gasket or strip can seat.

It is still another feature of the present invention that the improved separator has its frame portion beveled and recessed on the opposing side to receive the central mesh portion which is heat sealed to the frame, thereby avoiding rough surfaces that can tear the membrane.

It is yet another feature of the present invention that the separator extends beyond the external periphery of the cell electrode backplates.

It is yet a further feature of the present invention that the separator central mesh portion is either coated with titanium dioxide or is filled with titanium dioxide and then fastened to the separator frame.

It is an advantage of the present invention that the separator supports the adjacent wetted membrane during assembly of the electrolytic membrane cell.

It is another advantage of the present invention that the separator prevents salt bridging from occurring between adjacent electrode backplates and by extending beyond the periphery of adjacent electrode backplates prevents shorting between adjacent elements from occuring by the inadvertent contact of adjacent electrode backplates by metallic objects.

It is yet another advantage of the present invention that the separator is hydrophilic and provides a more wettable surface.

These and other objects, features and advantages of the invention are provided in an electrolytic membrane cell that electrochemically produces an alkali metal hydrosulfite by the reduction of an alkali metal bisulfite component of a circulated aqueous catholyte solution in a cell having an improved separator positioned between the adjacent anode backplates and membranes.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
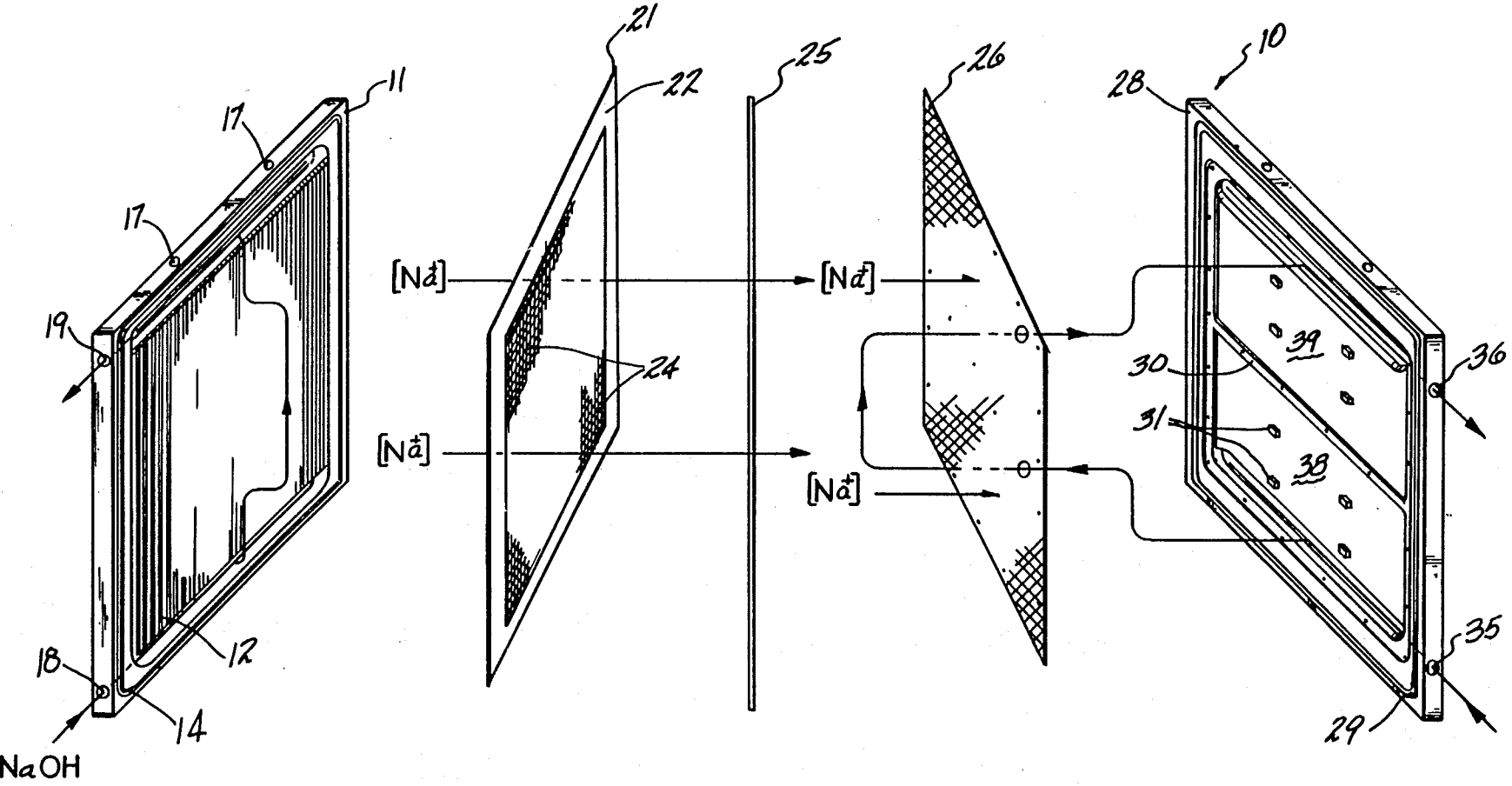
FIG. 1 is a diagrammatic exploded view of the electrolytic cell showing the electrolyte flow paths and the ion flow paths.

As seen in the exploded and partially diagrammatic illustration in FIG. 1, a filter press membrane electrolytic cell, indicated generally by the numeral 10, is shown consisting of an anode backplate 11, separator means 21, cation selective membrane 25, a porous cathode plate 26, and a cathode backplate 28.

The anode backplate 11 and cathode backplate 28 form the opposing sides of the bipolar electrode, which can be machined from a stainless steel plate or can be cast stainless steel. The stainless steel plate can, for example, be formed of 304L or 316 stainless steel as thick as 1¼" which is resistant to corrosion and is simply fabricated by machining the flat plate to create chambers through which the anolyte and catholyte fluids can pass into their respective anolyte and catholyte chambers. The thickness of the stainless steel plate provides stiffness and an extremely precise flatness to the structure. The cathode plate 26 is mounted to the cathode backplate 28 by screws (not shown) which are screwed into cathode support pedestals 31, while the anode rods 12 may be welded, such as by TIG welding, in place without warping the stainless steel plate.

Figure 2:
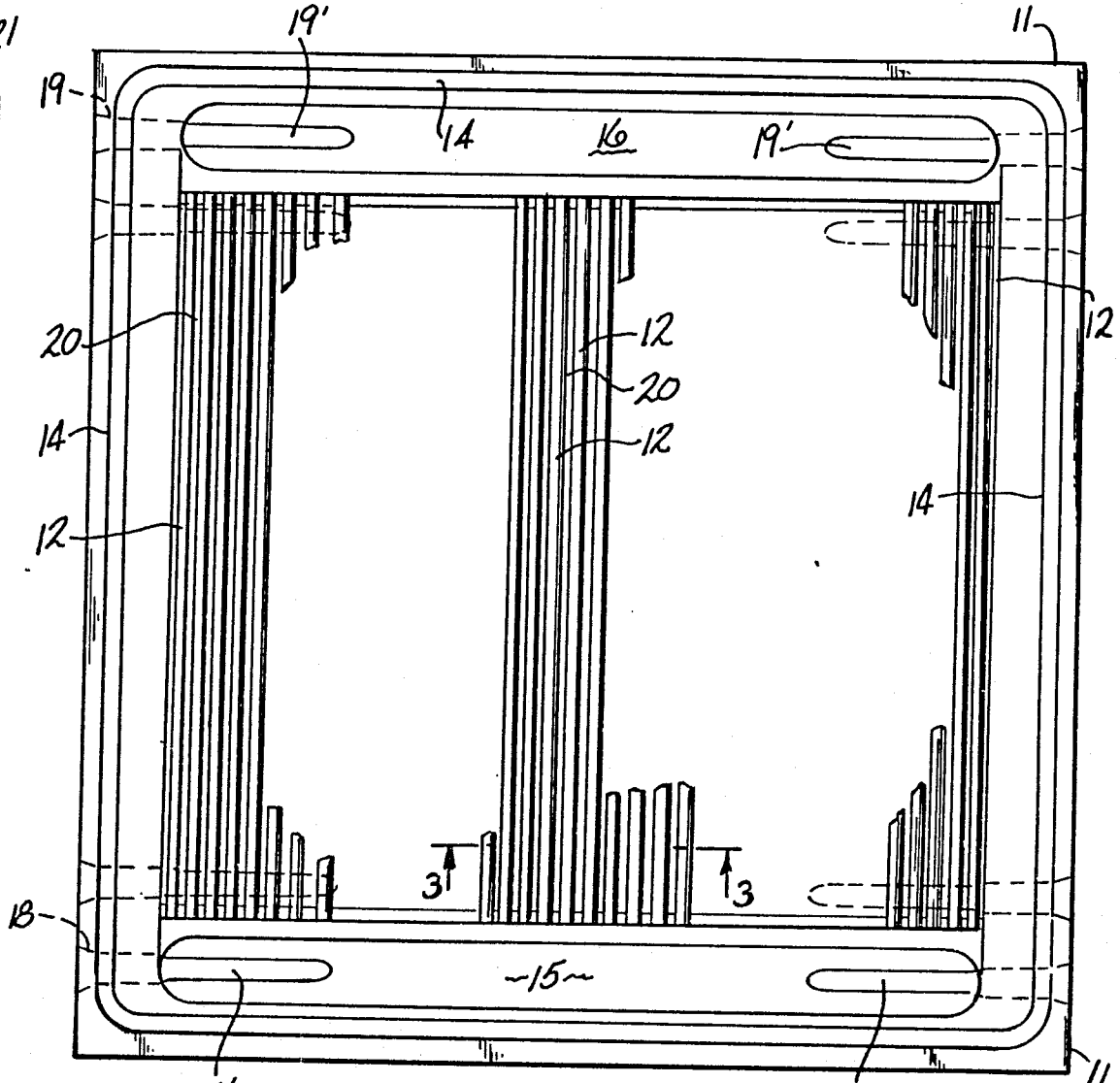
FIG. 2 is a side elevational view of the anode side of the bipolar cell electrode showing a portion of the anode rods that cover the anode backplate, further having some of these shown rods broken away.
Figure 6:
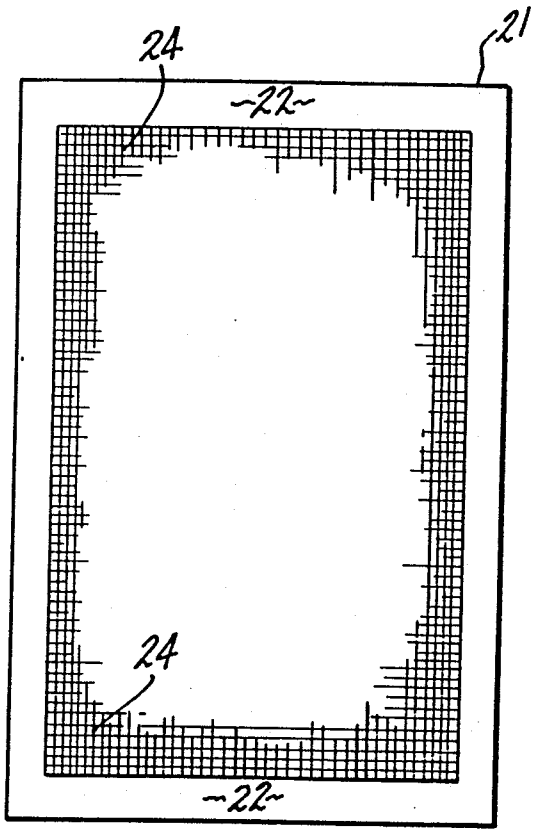
FIG. 6 is a side elevational view of the separator screen that is positioned between the anode rods and the membrane.
Figure 3:
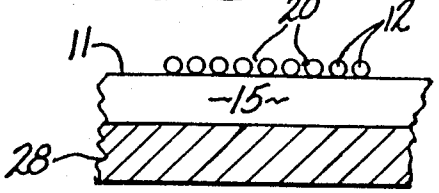
FIG. 3 is an enlarged partial sectional view taken along the lines 3—3 of FIG. 2 showing the anode rods as they are fastened to the electrode.

The anode structure can be seen in greater detail in FIGS. 2 and 3. As seen in FIG. 2, the anode backplate 11 has a plurality of parallel positioned, vertically extending anode rods 12 welded at the top and bottom portions of the rods to the anode backplate 11. These rods 12 extend across the entire width of the anode backplate 11, although for simplicity of illustration the continuous side-by-side arrangement has not been shown in FIG. 2 since rods in the central portion of the anode backplate 11 have been omitted entirely. These rods are, for example, ⅛" diameter nickel wire rods spaced apart from each other to create an anode inter-rod gap 20 of approximately 1/16" between adjacent rods. These anode rods 12 can be formed from nickel 200, or any other corrosion resistant composition providing low overvoltage characteristics. The vertical positioning of the anode rods 12 with the anode inter-rod gap 20, see briefly FIG. 3, provides clear flow channels from the bottom of the anode backplate 11, where the anolyte fluid enters via anolyte entry ports 18 into an anolyte distribution groove 15, to the top. Anolyte fluid flows vertically upwardly in the anode inter-rod gaps 20 to the anolyte collection groove 16 before the liquid exits the cell through the anolyte exit ports 19. The vertical positioning of the anode rods 12 provides even current distribution across the anode and avoids gas blinding that can occur from the buildup of gas bubbles, which can consequently reduce the current density in the operating cell.

Both the anolyte entry ports 18 and the anolyte exit ports 19 have transition slots 18' and 19', respectively, that are machined into the stainless steel plate. The anolyte entry port transition slots 18' are machined into the anolyte distribution groove 15 to provide a smooth transition surface that is tapered and avoids erosion corrosion which can interfere with the smooth flow of the anolyte into the cell 10 and which will provide metal contamination as the erosion and corrosion occurs. The anolyte exit port transition slots 19' are both similarly positioned and machined.

An anode gasket groove 14 is machined into the anode backplate 11 about the entire periphery. The groove, for example, is ⅜" wide by 3/16" deep to receive a rectangular anode gasket (not shown) that is ⅜" wide by ⅜" deep. This gasket can have a strip of material, such as material sold under the tradename of GORE-TEX or TEFLON, positioned over the gasket to come into contact with the plastic separator means 21 when the cell is compressed and assembled.

The plastic separator means 21 is formed from any material resistant to anolyte corrosion, such as polymers and preferably polypropylene has been employed. An 8 mesh polypropylene fabric with an approximately 40% open area has been successfully employed, as has a titanium dioxide filled polyethylene mesh. The separator means 21 has a separator frame 22 that is solid about the periphery and a separator mesh 24 on the interior of the separator frame 22. The mesh 24 is treated with a hydrophilic coating to prevent gas bubbles from adhering to the mesh and the adjacent membrane by capillary action. A coating of titanium dioxide applied to the mesh 24 has been successfully employed as the hydrophilic coating. Preventing the buildup of gas bubbles on the membrane and in the mesh avoids cell voltage fluctuations during operation.

The use of the separator means 21 also has successfully prevented the buildup of regions of locally high acidity in the adjacent membrane where the membrane touches against the nickel anode rods 12. Having the membrane 25 touch against the nickel anode rods 12 can create pockets of high acidity because the sulfur species become oxidized to sulfuric acid due to the slow migration of the sulfur species back through the membrane during operation of the cell. The nickel oxide coating on the anode rods 12 breaks down and nickel corrosion occurs. This corrosion is transported through the membrane to the cathode side of the cell 10. There this nickel corrosion is reduced to the metallic state by the hydrosulfite solution. This metallic state nickel adheres tightly to the membrane on the cathode side and will impair the transport of ions and fluid through the membrane.

The anode has been designed so that the anolyte which is electrolyzed in the cell 10 is any suitable electrolyte which is capable of supplying alkali metal ions and water molecules to the cathode compartment. Suitable as anolytes are, for example, alkali metal halides, alkali metal hydroxides, or alkali metal persulfates. The selection of anolyte is in part dependent on the product desired. Where a halogen gas such as chlorine or bromine is wanted, an aqueous solution of an alkali metal chloride or bromide is used as the anolyte. Alkali metal hydroxide solutions are chosen where oxygen gas or hydrogen peroxide is to be produced. If persulfuric acid is the desired product, an alkali metal persulfate is employed. However, alternate materials of construction, such as titanium group metals for the anolyte wetted parts with an alkali metal chloride anolyte, would be necessary for each particular anolyte utilized.

In any case, concentrated solutions of the electrolyte selected are employed as the anolyte. For example, where sodium chloride is selected as the alkali metal chloride, suitable solutions as anolytes contain from about 12 to about 25 percent by weight of NaCl. Solutions of alkali metal hydroxides, such as sodium hydroxide, contain from about 5 to about 40 percent by weight of NaOH.

The cell 10 preferably has been operated with caustic soda. Where caustic soda (NaOH) is used, water and the caustic soda enter through the anolyte entry ports 18 and the solution flows along the high velocity flow path between the adjacent anode rods 12 and the anode inter-rod gaps 20 at the rear of the anolyte compartment toward the top of the cell 10. Thus, most of the anolyte fluid volume flow occurs between the anode rods 12 and within the hydrophilically treated separator mesh 24. The sodium ions migrate across the membrane, being produced as a result of the electrolysis reaction forming oxygen, water and sodium ions, $$4NaOH \rightarrow O_2 + 4Na^+ + 2H_2O.$$

Depleted caustic passes out with oxygen and water through the anolyte exit or collection ports 19.

Figure 5:
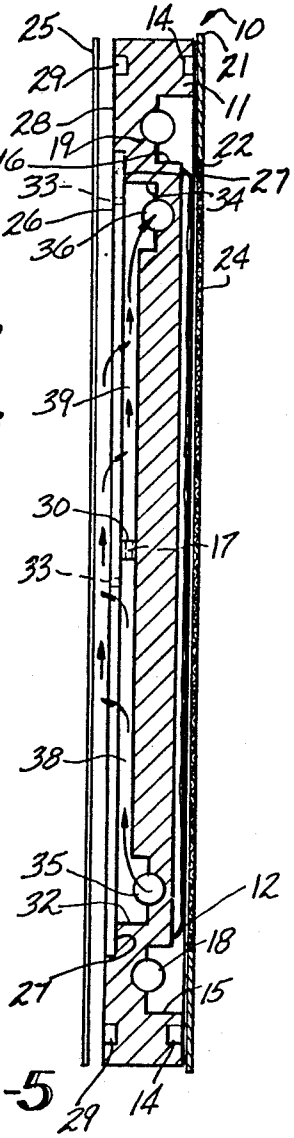
FIG. 5 is a side sectional view of the bipolar electrode element of the electrolytic cell showing the flow path of the catholyte through the porous cathode in the cathode compartment from the catholyte distribution slots to the catholyte collection slots or conduits.
Figure 4:
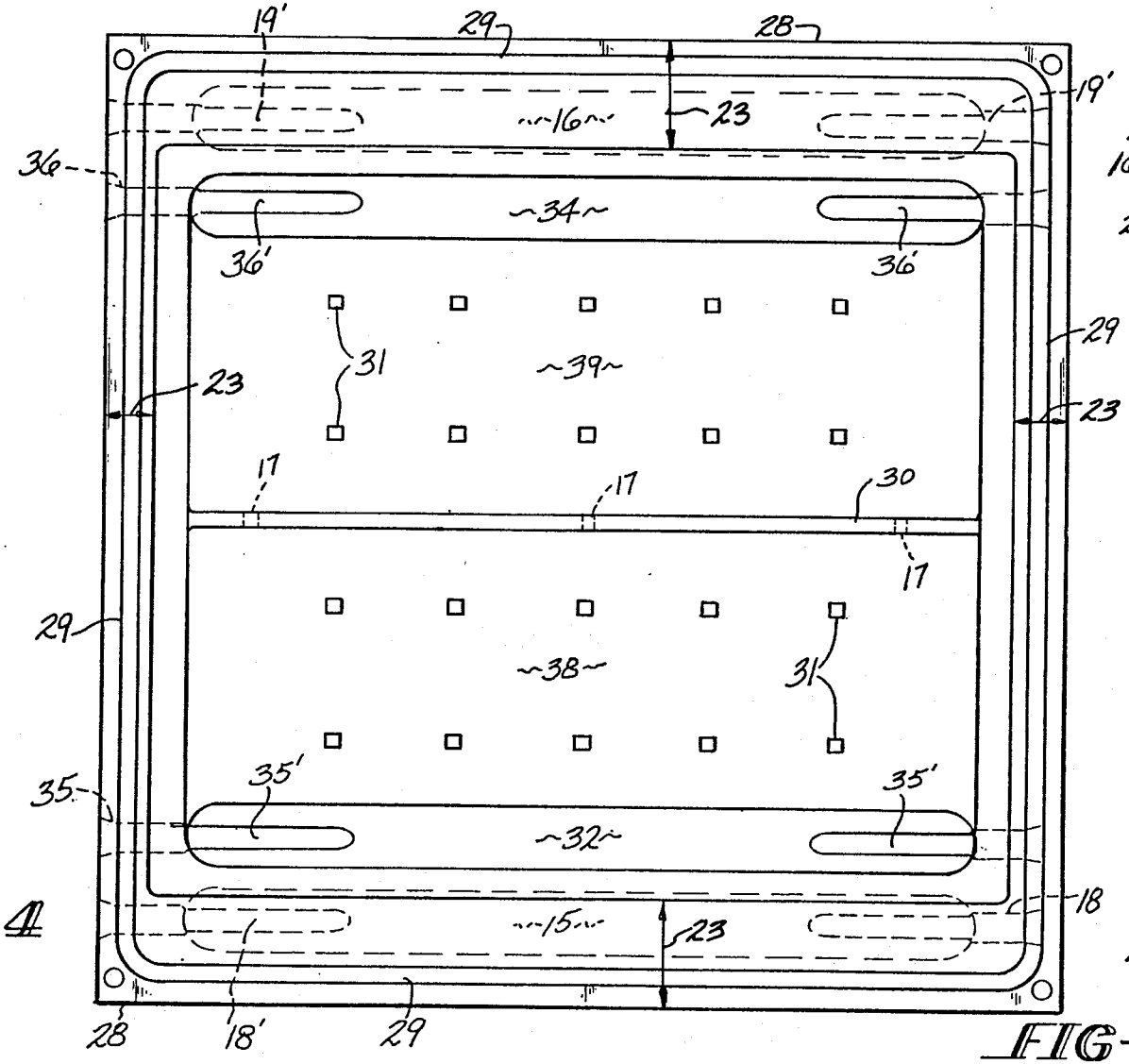
FIG. 4 is a side elevational view of the cathode side of the bipolar electrode.

The cathode backplate 28 is best seen in FIG. 4, while the monolithic nature of the electrode that is machined from the solid stainless steel plate can be seen in FIG. 5. Since the cell is bipolar, the cathode is on one side of the stainless steel plate on the cathode backplate 28 side, while the anode backplate 11 and the anode is on the opposing side. As seen best in FIG. 4, the cathode backplate 28 has catholyte entry ports 35 on the opposing sides of the bottom portion of cathode backplate 28 that feed in catholyte into the catholyte distribution groove 32. Catholyte distribution groove 32, catholyte entry ports 35, and the machined catholyte transition slots 35' are positioned just above the corresponding anolyte distribution groove 15, anolyte ports 18 and the anolyte transition slots 18', but are on the opposite side of the solid stainless steel electrode plate.

A lower catholyte chamber 38 is positioned immediately above the catholyte distribution groove 32. The lower catholyte chamber 38 is separated from the upper catholyte chamber 39 by a generally horizontally positioned cathode flow barrier 30. Flow barrier 30 extends across the entire width of the catholyte chamber and protrudes outwardly from the plane of the catholyte backplate 28, as can be seen also in FIGS. 1 and 5. Cathode flow barrier 30 interrupts the vertical flow of catholyte fluid upwardly from the lower catholyte chamber 38 into the upper catholyte chamber 39, thereby causing the catholyte fluid to flow in a path shown by the arrows in FIG. 1 that takes it twice through the cathode plate 26 enroute to the upper catholyte chamber 39. This flow path results in a cathode with a highly effective surface area, but requires the use of a very porous cathode plate that will permit at least 30% by volume of the catholyte fluid to flow through the porous cathode plate 26 rapidly to hold to a minimum the residence time of the catholyte in the cell. As will be described in greater detail hereafter, once the catholyte fluid has reached the upper catholyte chamber 39 it enters the catholyte collection groove 34 and exits the cell through the machined catholyte exit transition slots 36' and catholyte exit ports 36.

Weep holes 17, as seen in FIGS. 4 and 5, can be used in the cathode flow barrier 30 to permit hydrogen gas to rise from the lower catholyte chamber 38 to the upper catholyte chamber 39. Alternately or concurrently weep holes 33, seen in FIG. 5, can be used to permit the hydrogen gas to pass out of the interelectrode gap between the walls of the lower and upper catholyte chambers 38 and 39 and the cathode plate 26 just below the cathode flow barrier 30 and then back through the cathode plate 26 opposite the catholyte collection groove 34.

The cathode plate 26 is held in place on the catholyte backplate 28 by a plurality of screws (not shown) that seat within the plurality of cathode support pedestals 31 within the lower and upper catholyte chambers 38 and 39.

The cathode plate 26 is a highly porous multilayer structure. It comprises a support layer formed of perforated stainless steel. This support layer forms the mounting base and protects the innermetal fiber felt layer that is formed of, for example, 15% dense, very fine 4 to 8 micron fibers and 15% dense 25 micron fibers laid on top of one another. A wire screen of, for example, 18 mesh with a 0.009 inch wire diameter is then placed atop the fiber felt to form a cathode that has a porosity of preferably between 80 and 85%. The cathode plate 26, thus, is a four layered sintered composite with all of the materials made of stainless steel, preferably 304 or 316 stainless steel, and in the appropriate sheet size. The highly effective surface area of cathode plate 26 is achieved by the use of low density metal felt formed from very fine elements.

A cathode gasket groove 29 is seen in FIG. 4 extending about the top bottom and side peripheral portions 23 of the cathode backplate 28. Although not shown, a ⅜" round EPDM, ethylene-propylene-diene monomer, gasket is used to seat within the cathode gasket groove 29 to effect fluid-tight sealing.

Reduction occurs at the cathode in the cell 10 by the electrolysis of a buffered aqueous solution of an alkali metal bisulfite. A typical reaction is as follows:

$$4NaHSO_3+2e^-+2Na^+\rightarrow Na_2S_2O_4+2Na_2SO_3+2\text{-}H_2O.$$

Depleted caustic and sulfur dioxide are mixed to form $NaHSO_3$ that is fed into the catholyte distribution groove 32 via the catholyte entrance ports 35 and the catholyte transition slots 35'. This catholyte liquid then rises vertically upwardly until it passes out through the cathode plate 26, as best seen in FIGS. 5 or 1. The cathode flow barrier 30 acts as a block to the straight vertical flow of the catholyte fluid upwardly from the lower catholyte chamber 38 into the upper catholyte chamber 39. There is an approximately ⅛" interelectrode cathode gap between the walls of the lower and upper catholyte chambers 38 and 39 and the cathode plate 26 that is seated on the cathode support pedestals 31. The catholyte fluid then passes through the cathode plate 26 and continues flowing upwardly through the cathode-membrane gap until it passes the cathode flow barrier 30. At this point the catholyte fluid passes back through the highly porous cathode plate 26 into the upper catholyte chamber 39 and then into the catholyte collection groove 34. The cell product solution containing $Na_2S_2O_4$ (dithionite) exits the cell 10 through the catholyte exit transition slots 36' and the catholyte exit ports 36.

A buffer solution containing from about 40 to about 80 gpl of bisulfite is utilized with the catholyte because of sodium thiosulfate formation resulting from the reduction and decomposition of hydrosulfite (dithionite) and the pH change of the catholyte as bisulfite is consumed and sulfite is formed according to the reaction $$Na_2S_2O_4+2e^-+2Na^++2NaHSO_3\rightarrow Na_2S_2O_3+\text{-}2Na_2SO_3+H_2O.$$

This hydrosulfite decomposition reaction is electrolytically driven by the presence of electrons. When the potential is increased, so is the current density and to a point, the reaction rate of this undesired thiosulfate producing reaction.

The value of the multiple layered cathode plate 26 is particularly evident in its selectivity. Because the multiple layered electrode has an increased surface area, it requires less voltage or a lower potential to drive the primary reduction reaction that produces the desired hydrosulfite product and, thereby, reduces the amount of the undesired thiosulfate produced by the hydrosulfite decomposition reaction. The increased surface area permits the potential to be maintained at the lower level where the primary or desired hydrosulfite producing reaction predominates and generally below the level where the hydrosulfite decomposition reaction becomes a factor.

The use of a monolithic cell body, that is a bipolar cell body or backplate formed from a single plate of stainless steel machined to form an anode backplate on one side and a cathode backplate on the opposing side, provides several significant inherent operating advantages. Initially, there is no shifting or dimensional instability because of the joining of two separate pieces of material to form the electrode. There is a reduction in the number of actual cell components from the use of a single machined plate. Lastly, and perhaps most significantly, there is the elimination of electrical loss from the contact between two separate anode and cathode elements that would otherwise have some spacing and sizing differences. This particular configuration contributes to lower cell electrical energy consumption.

The hydraulic pressure in cell 10 is established so that the membrane 25 is kept pressed against the separator means 21 and off of the cathode plate 26. Keeping the membrane 25 so positioned also permits the flow path through the cathode plate to be accomplished. The cathode flow barrier 30 further contributes to the hydraulics of the cell 10 by achieving a uniform pressure across the entire height of the cathode due to the flow inversion characteristics achieved by the multiple flow paths through the cathode plate 26.

Figure 7:
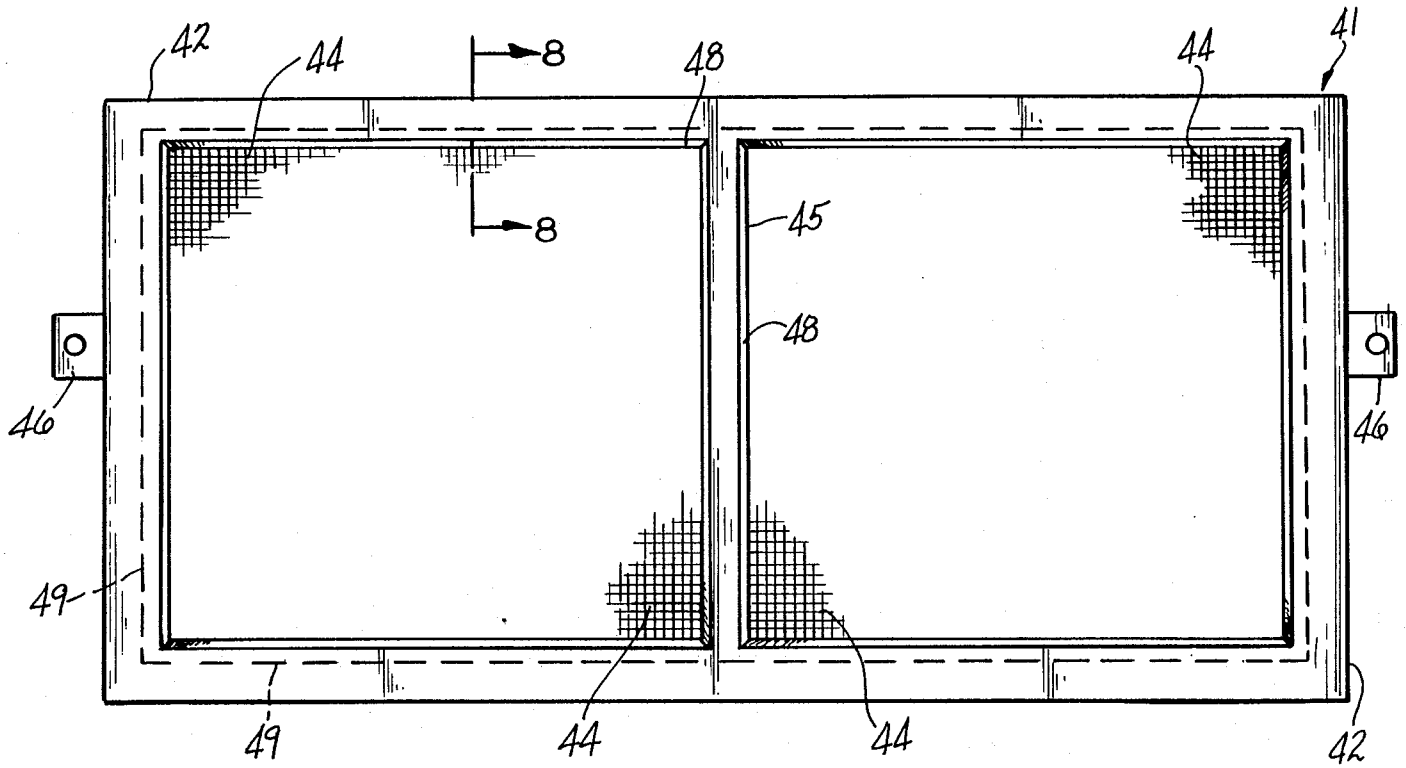
FIG. 7 is a side elevational view of an alternative embodiment of the separator means showing the central mesh portion partially broken away, the supporting peripheral frame and the central reinforcing strip.

FIG. 7 shows an alternative embodiment of the separator means, indicated generally by the numeral 41, that can be used in an enlarged design. Separator means 41 is longer, but is still surrounded by a peripheral frame 42 which has appropriately fastened thereto the central portion, the separator mesh 44. Mesh 44 and this frame 42 are reinforced by the central reinforcing strip 45, which also serves to mask a generally vertical area on the enlarged cathode backplate 28 where current flow is not desired.

Figure 8:
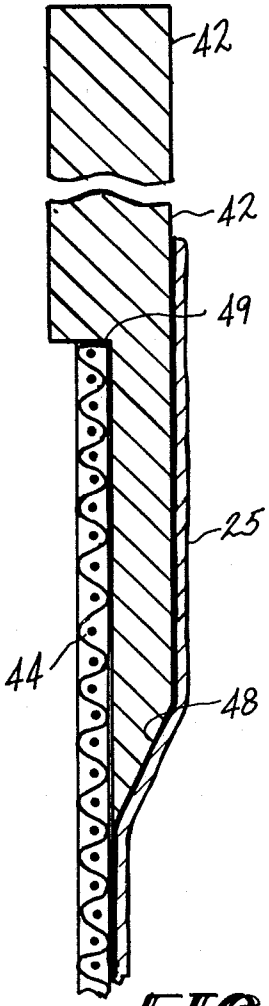
FIG. 8 is an enlarged partial sectional view taken along the lines 8—8 of FIG. 7 showing the beveled and recessed portions of the separator frame and the relative positioning of the membrane against the separator.

FIGS. 7 and 8 show how the inner edge portions 48 of the frame and the reinforcing strip 45 are beveled toward the separator mesh 44. This permits the membrane 25, best seen in FIG. 8, to be gradually and evenly brought into contact with the mesh 44. As is also seen in FIG. 8, the separator frame 42 has a recessed portion 49 to receive the central mesh 44. The mesh 44 is appropriately fastened to the recessed portion 49, such as by heat sealing, about the entire recessed periphery of the frame 42 and along the central reinforcing strip 45.

Figure 9:
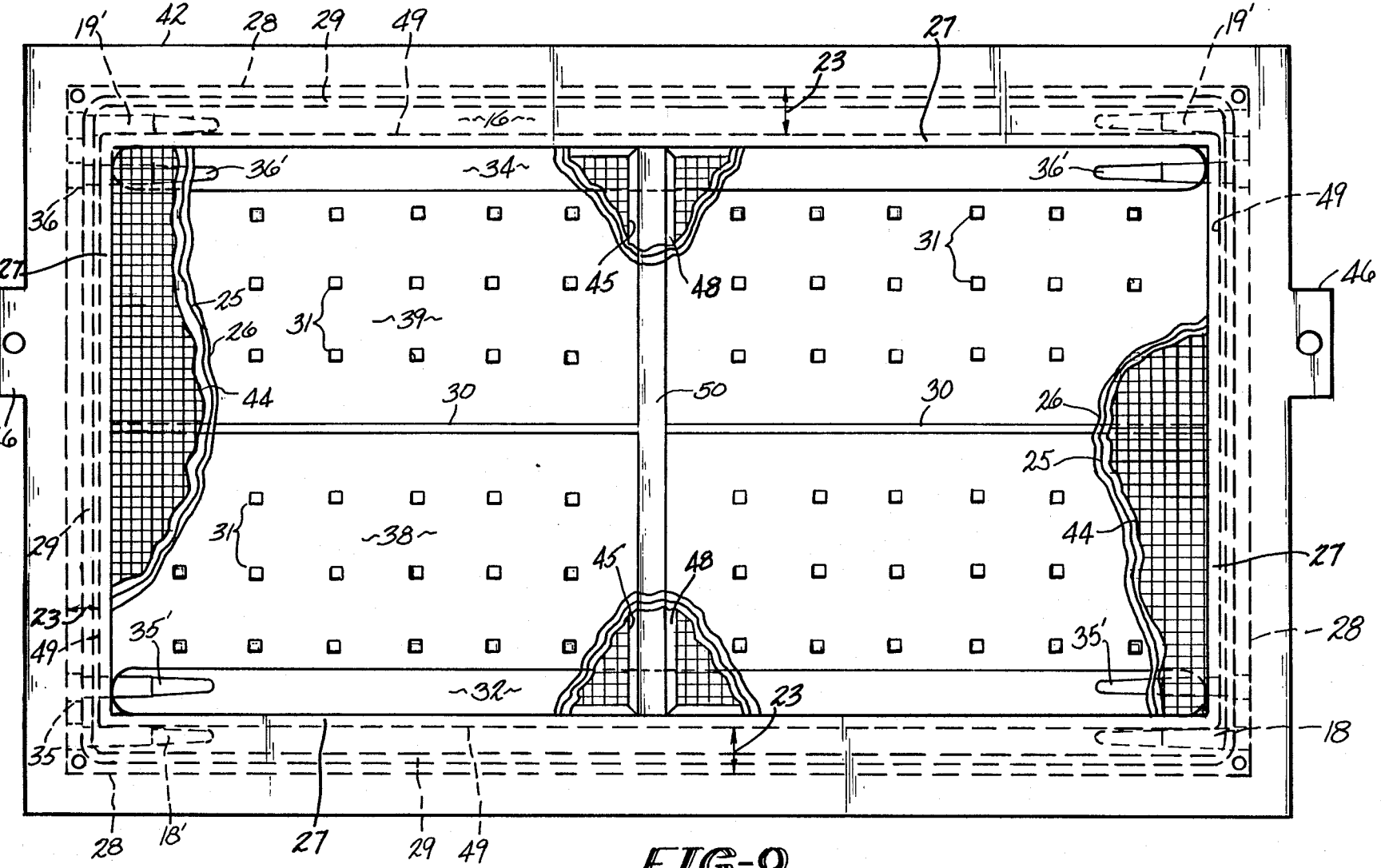
FIG. 9 is a side elevational view of the cathode side of an alternative embodiment of the bipolar electrode with major portions of the membrane, porous cathode plate and the separator central mesh portion broken away showing how the separator frame and central reinforcing strip mask the areas of poor or no catholyte circulation from electrical flow.

FIG. 9 illustrates how the frame 42 and the central reinforcing strip 45 of separator means 41 mask the desired areas of the cathode side of an alternative embodiment of the bipolar electrode from exposure to cell electrolyte and electric current, with major portions of the membrane 25, porous cathode plate 26, separator central mesh portion 44 and central reinforcing strip 45 broken away. Vertical reinforcing strip 50 in the cathode backplate 28 is masked by central reinforcing strip 45. These areas are thus effectively shielded from the flow of electric current. The current only passes through the mesh portion 44 of the separator means 41 where there is good catholyte circulation and not where there is poor or no circulation. The current does not flow directly into the top, bottom or side peripheral portions of the cathode backplate 28 or where the cathode plate 26 rests on the cathode plate support shoulder 27 in the backplate 28, which would cause undesirable thiosulfate contaminant to be produced. The separator means 41 similarly masks the top, bottom and side peripheral portions of the anode backplate 11 outside of the anode rods 12 to prevent undesired corrosion from occurring. Thus, by the design of the separator means 41 and its central mesh portion 44, electrical current is allowed to flow to only those areas of the cell where the most efficient and desired electrochemical reaction occurs.

An additional benefit is obtained from the solid separator frames 22 and 42 since they form a good seal with the adjacent membranes 25 to prevent leakage. A strip of, for example, polypropylene foam or material sold under the tradename GORE-TEX about the frames 22 and 42 cooperates with the previously mentioned EPDM gasket and with the separator frames 22 and 42 to form an effective seal.

FIGS. 7 and 9 show separator support tabs 46 on the separator means 41 that are used to support the separator means 41 on support channels (not shown) which are on opposing sides of the cell 10 to assist in assembly and to retain the assembled cell during operation. Anode backplate 11 and cathode backplate 28 have suitable electrical non-conducting blocks of material (also not shown) bolted to their opposing sides in the same relative position as the separator support tabs 46 to permit the electrode elements to be similarly assembled and supported. Vertically assembling the cell 10 in this manner permits the pretreated, wet membrane to be placed against separator means 41 and remain supported by separator means 41 during the assembly process.

The electrolytic cell 10 is operated at current densities which are sufficient to produce solutions of alkali metal hydrosulfites having the concentrations desired. For example, where sodium hydrosulfite is produced for commercial sale, the solutions contain from about 120 to about 160 grams per liter. However, since the alkali metal hydrosulfite solutions sold commercially are usually diluted before use, these dilute aqueous solutions can also be produced directly by the process.

Current densities of at least 0.5 kiloamperes per square meter are employed. Preferably the current density is in the range of from about 1.0 to about 4.5, and more preferably at from about 2.0 to about 3.0 kiloamperes per square meter. At these high current densities, the electrolytic cell 10 operates to produce the required volume of high purity alkali metal hydrosulfite solution which can be employed commercially without further concentration or purification.

The electrolytic membrane cell 10 employs a cation exchange membrane between the anode and the cathode compartments which prevents any substantial migration of sulfur-containing ions from the cathode compartment to the anode compartment. A wide variety of cation exchange membranes can be employed containing a variety of polymer resins and functional groups, provided the membranes possess the requisite sulfur ion selectivity to prevent the deposition of sulfur inside membranes. Such deposition can blind the membranes, the result of sulfur species diffusing through the membranes and then being oxidized to create acid within the membranes that causes hydrosulfite and thiosulfate to decompose to sulfur in acidic conditions. This selectivity can be verified by analyzing the anolyte for sulfate ions.

Suitable cation exchange membranes are those which are inert, flexible, and substantially impervious to the hydrodynamic flow of the electrolyte and the passage of gas products produced in the cell. Cation exchange membranes are well-known to contain fixed anionic groups that permit intrusion and exchange of cations, and exclude anions, from an external source. Generally the resinous membrane has as a matrix or a cross-linked polymer to which are attached charged radicals, such as $-SO_3^=$, $-COO^-$, $PO_3^=$, $-HPO_2^-$, $-AsO_3^=$, and $-SeO_3^-$ and mixtures thereof. The resins which can be used to produce the membranes include, for example, fluorocarbons, vinyl compounds, polyolefins, and copolymers thereof. Preferred are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid groups" are meant to include salts of sulfonic acid or salts of carboxylic acid groups by processes such as hydrolysis. Suitable cation exchange membranes are sold commercially by E. I. DuPont de Nemours & Co., Inc. under the trademark "Nafion", by the Asahi Glass Company under the trademark "Flemion", by the Asahi Chemical Company under the trademark "Aciplex". Perfluorinated sulfonic acid membranes are also available from the Dow Chemical Company.

The membrane 25 is positioned between the anode and the cathode and is separated from the cathode by a cathode-membrane gap which is wide enough to permit the catholyte to flow between the cathode plate 26 and the membrane 25 from the lower catholyte chamber 38 to the upper catholyte chamber 39 and to prevent gas blinding, but not wide enough to substantially increase electrical resistance. Depending on the form of cathode plate 26 used, this cathode-membrane gap is a distance of from about 0.05 to about 10, and preferably from about 1 to about 4 millimeters. The cathode-membrane gap can be maintained by hydraulic pressure of mechanical means. This design and the catholyte flow path permits almost all of the catholyte liquid to contact the active area of the cathode. Further, with this design the majority of the electrolytic reaction occurs in the cathode area nearest the anode.

Suitable porous cathode plates 26 used in the cell 10 have at least one layer with a total surface area to volume ratio of greater than 100 $cm^2$ per $cm^3$, preferably 250 $cm^2$ per $cm^3$, and more preferably greater than 500 $cm^2$ per $cm^3$. These structures have a porosity of at least 60 percent and preferably from about 70 percent to about 90 percent, where porosity is the percentage of void volume. The ratio of total surface area to the projected surface area of the porous cathode plate 26, where the projected surface area is the area of the face of the cathode plate 26, is at least about 30:1 and preferably at least from about 50:1; for example, from about 80:1 to about 100:1.

The cathode plate 26 preferably is comprised of four layers. The first layer is a support layer of perforated stainless steel plate approximately 0.036 inches thick with 1/16 inch holes on ⅛ inch 60 degree staggered centers. These holes in the first layer 41 give the perforated stainless steel plate an open area of approximately 23 percent. The second layer is preferably formed of 304 stainless steel fibers that are about 20 to about 100 microns in diameter and, preferably, about 25 microns in diameter. The second layer has the density of approximately 0.62 pounds per square foot. Alternately, the second layer can be a woven screen mesh with a 30 fibers per inch by 30 fibers per inch square weave and about a 23% open area. The third layer is much less dense than the second layer and is comprised of 304 stainless steel fibers of about 4 to about 16 microns in diameter and, preferably, about 8 microns in diameter. The density of the third layer is about 0.12 pounds per square foot. The limiting factor in the diameter sizing of the fibers of the second layer and the third layer is that the fibers of the second layer can't extend up through the fibers of the third layer. The fourth layer is a mesh wire cloth that is preferably 18×18 mesh with about a 0.009 inch diameter of the individual wires in the wire cloth. The four layers are compressed together and bonded by sintering in a reducing atmosphere, such as hydrogen, ammonia or carbon monoxide, to form a single sheet with a preferred thickness of about 0.155 inches, plus or minus about 0.008 inches.

The cathode plate 26 of this design provides a high mass transfer capability because the surface area of the electrode is the same surface area used for electrolysis. Because the cathode plate 26 is relatively thin, it requires a high surface area to volume ratio, thereby creating a high total surface area. This is especially applicable to the third layer which is the most active layer and is critical in determining the characteristics of the cathode. The high surface area of the cathode plate 26 is measured as the ratio of the total surface area of the individual fibers to the superficial or projected surface area of the total cathode plate 26. The relationship between these parameters can be expressed as the thickness of an individual layer in the cathode plate 26 times the surface area to volume ratio equals the superficial surface area. The selection of the fibers of the second layer with a greater individual diameter than the fibers of the third layer and an equal porosity provide a structure that has a greater surface area near the membrane 25. The fibers of the second and third layers can equally well be selected from different grades of stainless steel, nickel, steel, copper, carbon graphite or ferrous and-non-ferrous alloys. The cathode plate 26 could have an electroactive coating, such as ruthenium oxide or platinum, added to the surface area to obtain a more active electrode surface area.

Current is conducted into the cell 10 through anode and cathode current conductor plates (not shown). Plates of copper the size of the electrodes are placed against the end cathode and end anode in each cell 10. Electrical connections are made directly to these copper plates. An insulator plate made, for example, of polyvinyl chloride or other suitable plastic, and a compression plate (both not shown) made for example, of stainless steel or steel, are placed against each end of the cell 10 before it is assembled to form a sandwich around the desired number of electrodes that are positioned therebetween.

The cell of the instant invention could also be designed as monopolar, requiring that both sides of each stainless steel plate be identically machined and that half electrodes be used as the end electrodes in the assembled cell. The current conductors in the monopolar design would then be standard copper electrical terminals for each electrode.

Additionally the cell of the present invention could be utilized in electrochemical reactions other than the production of hydrosulfite. Typical is the production of organic products by electrochemistry, such as the electrochemical transformations of pyridines through oxidation or reduction reactions in a cation-exchange membrane divided cell of the instant design.

Employing the novel design of the cell 10, concentrated alkali metal hydrosulfite solutions are produced having low concentrations of alkali metal thiosulfates as an impurity in electrolytic membrane cells operating at high current densities, substantially reduced cell voltages, and high current efficiencies.

In order to exemplify the results achieved, the following examples are provided without an intent to limit the scope of the instant invention to the discussion therein.

EXAMPLE 1

A cell of the type shown in FIGS. 1–5 was assembled from three stainless steel plates which were mounted on a rack to form two anode/cathode pairs whose active electrode area was about 0.172 square meters each. The plates formed two half electrodes, one a cathode and the other an anode, sandwiched about a bipolar electrode with opposing anode and cathode faces. The outside dimensions of the electrode plates were about 17 inches wide by about 18.5 inches high and about 1.0 inches thick.

The anodes were comprised of about forty-seven (47) ⅛ inch diameter nickel 200 rods welded onto the anode backplate, as shown generally in FIG. 2, with approximately 1/16 inch separation between the rods. The anolyte collection and distribution grooves were about 1.25 inches wide and about 0.61 inches deep.

The cathode plate was formed from a four layered sheet cut to size. The first layer was a support layer formed of perforated stainless steel 0.036 inches thick with 1/16 inch holes on ⅛ inch 60° staggered centers having a 23% open area. The second layer was a 0.62 pounds per square foot layer of 304 stainless steel fibers about 25 microns in diameter. The third layer was a 0.12 pounds per square foot layer of 304 stainless steel fibers about 8 microns in diameter. The fourth layer was an 18″×18″ mesh of about 0.009 inch diameter wire cloth. These layers were compressed together and bonded by sintering in a hydrogen atmosphere to form a single sheet with a thickness of about 0.155 inches. The cathode sheet was cut to form a cathode plate of about 18.5 inches by about 17 inches.

The cathode plate was mounted onto the stainless steel cathode backplate using 20 screws of about ⅛ inch diameter that seated into the cathode support pedestals within the catholyte chambers. A small coating of appropriate electrical joint compound was used on the threads of the screws and a silicon cement was placed over the head of each screw to prevent the screw from becoming an active part of the cathode assembly.

Six (06) 1/6 inch diameter holes were drilled in the cathode plate to permit gas bubbles trapped within the cell to escape. Three of the holes were drilled near the top of the cell opposite the catholyte collection groove and three just below the cathode flow barrier.

Separator means were formed from polypropylene mesh treated with a coating of titanium dioxide. The separators were mounted in 1/16 inch thick separator frames cut to fit just inside the gasket groove in the cell.

Gasket grooves about 0.375 inches wide and about 0.187 inches deep were machined into both the anode and cathode backplates. On the anode side of the cell about a 0.375 inch square gasket was used with about a 0.5 inch wide strip of about 0.060 thick GORE-TEX® gasket tape placed on top. In the cathode gasket groove a rubber O-ring of about a 0.378 inch diameter was used. The cell was assembled using a portable hydraulic assembly system described in U.S. Pat. No. 4,430,179 that compressed the cell together so that approximately a ⅛ inch gap between the anode and the cathode plates remained. The cell was then secured by retaining nuts.

The cell was operated continuously for 42 days. The cell employed a NAFION® NX 906 perfluorinated membrane that was soaked in about 2% sodium hydroxide solution for at least 4 hours prior to assembling.

The cell was operated at a temperature of approximately 25° C. with a total catholyte flow rate of about 6 gpm and a total anolyte flow rate of about 4 gpm. Excess anolyte containing about 19% sodium hydroxide was continuously purged and added to the catholyte circulation while the anolyte was continuously replenished with the addition of about 69 grams per minute of about 35% sodium hydroxide solution. About 230 milliliters per minute of deionized water was continuously added to the catholyte, as was sulfur dioxide to the catholyte to maintain a pH of between about 5.4 and about 5.8 and a sulfite to bisulfite molar ratio of about 1:3 to about 1:8.

Product catholyte was drawn from the cell continuously at a rate of about 287 milliliters per minute and was analyzed periodically during each day. The product catholyte reflected in the following Table I was analyzed from samples taken at the same time each day. These data are representative of the operation of the cell during 4 days of operation under optimized conditions. The catholyte was analyzed for sodium hydrosulfite, sodium thiosulfate, sodium sulfite and sodium bisulfite content.

TABLE I

| Day | $Na_2S_2O_4$ (gpl) | $Na_2S_2O_3$ (gpl) | $Na_2SO_3$ (gpl) | $NaHSO_3$ (gpl) | Average Current Density ($KA/m^2$) | Current Efficiency (%) | Average Voltage Per Bipolar Electrode (volts) |
|---|---|---|---|---|---|---|---|
| 5 | 128.60 | 1.01 | 11.55 | 46.60 | 2.03 | 97.5 | 2.76 |
| 6 | 126.80 | 1.01 | 12.10 | 50.70 | 2.06 | 96.0 | 2.75 |
| 7 | 126.00 | 1.51 | 8.80 | 46.70 | 2.03 | 97.0 | 2.73 |
| 8 | 127.20 | 0.94 | 8.30 | 47.40 | 2.05 | 97.0 | 2.95 |

EXAMPLE 2

A cell similar to the design of Example 1 was assembled utilizing nine bipolar electrode plates and two half electrode plates, one an anode and one a cathode, having approximately a 0.051 square meter active electrode area for each. The same type of cathode plate and anode rods were used as in Example 1, except that the anode and cathode backplates were about 13.5 inches by about 13.5 inches and about 1.188 inches thick. A perfluorinated sulfonic acid membrane, with a thickness of about 2 mils and an equivalent weight of about 1000 (grams/gram-mole equivalent exchange capacity), available from the assignee of U.S. Pat. No. 4,470,888 was used.

The separator means were a mesh made from titanium dioxide filled polyethylene, the mesh being about 0.07 inch thick with approximately 0.38 inch openings and about 60% open area. The separator was treated with a mixture of chromic and sulfuric acids, available from Fisher Scientific under the name CHROMERGE to obtain the necessary hydrophilic surface. The separator mesh was mounted on a ⅛ inch separator frame that extended about ¼ inch beyond the edge of the cell.

The cell was sealed using about 0.290 inch diameter O-rings in both the anode and cathode backplate gasket grooves. A strip of about 0.875 inch GORE-TEX® tape was used between the separator frame and the membrane.

The cell operated with a total catholyte flow rate of 13 gpm and a total anolyte flow rate of 6 gpm. The anolyte had continuously added to it 93 grams per minute of 35% sodium hydroxide solution. Excess anolyte containing about 15% sodium hydroxide was continuously purged and and added to the catholyte circulation system. Additionally, about 320 milliliters per minute of deionized water was added to the catholyte, while sulfur dioxide was continuously added to the catholyte to maintain a pH of between about 5.4 to about 5.8 and a sulfite to bisulfite molar ratio of between about 1:3 to about 1:8.

The cell was operated at a temperature of about 25° C. with a total catholyte flow rate of about 13 gpm and a total anolyte flow rate of about 6 gpm. The cell was operated continuously for over 30 days without significant change in voltage coefficient or product composition.

Product catholyte was continuously withdrawn from the cell at a rate of about 350 milliliters per minute and was analyzed periodically during each day. The product catholyte reflected in the following Table II was analyzed from samples taken at the same time each day. These data are representative of the operation of the cell during 4 days of operation under optimized conditions. The catholyte was analyzed for sodium hydrosulfite, sodium thiosulfate, sodium sulfite and sodium bisulfite content.

TABLE II

| Day | $Na_2S_2O_4$ (gpl) | $Na_2S_2O_3$ (gpl) | $Na_2SO_3$ (gpl) | $NaHSO_3$ (gpl) | Average Current Density ($KA/m^2$) | Current Efficiency (%) | Average Voltage Per Bipolar Electrode (volts) |
|---|---|---|---|---|---|---|---|
| 7 | 141.5 | 4.46 | 9.58 | 56.50 | 1.92 | 98.25 | 2.33 |
| 8 | 140.1 | 4.06 | 9.58 | 57.40 | 1.92 | 96.20 | 2.28 |
| 10 | 138.4 | 5.18 | 9.07 | 51.50 | 1.92 | 95.00 | 2.32 |
| 13 | 141.4 | 4.50 | 7.06 | 49.80 | 1.92 | 93.20 | 2.38 |

While the preferred structure in which the principles of the present invention have been incorporated as shown and described above, it is to be understood that the invention is not to be limited to the particular details thus presented, but, in fact, widely different means may be employed in the practice of the broader aspects of this invention. For example, while the anode backplate is shown and described as employing round wire rods on its surface, flat rectangular bars or other appropriate geometrically shaped structures, such as triangular, pentagonal, hexagonal, octagonal, etc. could be equally well utilized. Additionally the separator mesh could be exposed to hydrophilic containing additives or such additives could be in the electrolyte. The separator mesh could also be assembled in the cell between the membrane and the cathode plate, in conjunction with the hydraulic pressure being changed so that the membrane is forced off of the anode rods and against the separator mesh. The scope of the appended claims is intended to encompass all obvious changes in the details, materials, and arrangement of parts, which will occur to one of skill in the art upon a reading of the disclosure.

Having thus described the invention, what is claimed is:

1. An electrolytic cell having a top and a bottom, receiving electric current from a power source and having an anolyte and a catholyte flowing therethrough, comprising in combination:

(a) an anode;

(b) a cation exchange membrane adjacent the anode;

(c) a porous multilayered cathode plate having a first surface adjacent the membrane and an opposing second surface;

(d) a cathode backplate adjacent the opposing second surface of the cathode plate having top, bottom and side peripheral portions and at least one central chamber through which catholyte fluid flows; and (e) separator means intermediate the anode and the membrane to prevent the membrane from touching the anode, the separator means further comprising a peripheral frame portion and a central mesh portion fastened to the peripheral frame portion on a first side, the central mesh portion being hydrophilic to prevent the buildup of gas bubbles and the peripheral frame portion being solid and masking the top, bottom and side peripheral portions of the cathode backplate from catholyte and electric current so that electrical current only flows through the central mesh portion.

2. The apparatus according to claim 1 wherein the peripheral frame portion has a recessed portion on the first side so that the central mesh portion fits therewithin and is fastened thereto.

3. The apparatus according to claim 2 wherein the peripheral frame portion of the separator means has an opposing second side which is adjacent the membrane and which is beveled downwardly from the peripheral frame portion toward the central mesh portion.

4. The apparatus according to claim 1 wherein the separator means is plastic.

5. The apparatus according to claim 4 wherein the separator means is polypropylene.

6. The apparatus according to claim 1 wherein the central mesh portion has at least about 40% open area.

7. The apparatus according to claim 1 wherein the central mesh portion has a hydrophilic coating applied thereto.

8. The apparatus according to claim 7 wherein the hydrophilic coating is titanium dioxide.

9. The apparatus according to claim 8 wherein the central mesh portion is titanium dioxide filled polyethylene.

10. The apparatus according to claim 1 wherein the central mesh portion is titanium dioxide filled polyethylene.

11. The apparatus according to claim 1 wherein the anode has top, bottom and side peripheral portions and at least one central chamber through which anolyte flows.

12. The apparatus according to claim 11 wherein the peripheral frame portion of the separator means masks the top, bottom and side peripheral portions of the anode to permit electrical current to flow to the anode only through the central mesh portion.

13. The apparatus according to claim 1 wherein the cathode backplate further has a flow barrier extending generally horizontally thereacross adjacent the opposing second surface of the cathode plate thereby defining an upper catholyte chamber and a lower catholyte chamber, the flow barrier interrupting the catholyte flowing between the top and the bottom of the cell causing substantially all of the catholyte to change flow direction and pass twice through the porous cathode plate to pass beyond the flow barrier and to exit the cell.

14. The apparatus according to claim 13 wherein the cathode backplate has a generally vertical reinforcing strip that bisects the flow barrier.

15. The apparatus according to claim 14 wherein the separator means further comprises a central reinforcing strip that masks the generally vertical reinforcing strip.

* * * * *